US010262851B2

(12) United States Patent
Bajic

(10) Patent No.: US 10,262,851 B2
(45) Date of Patent: Apr. 16, 2019

(54) IMPACTOR SPRAY ION SOURCE

(71) Applicant: Micromass UK Limited, Wilmslow (GB)

(72) Inventor: Stevan Bajic, Sale (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/504,180

(22) PCT Filed: Aug. 18, 2015

(86) PCT No.: PCT/GB2015/052390

§ 371 (c)(1),
(2) Date: Feb. 15, 2017

(87) PCT Pub. No.: WO2016/027073

PCT Pub. Date: Feb. 25, 2016

(65) Prior Publication Data

US 2017/0263428 A1 Sep. 14, 2017

(30) Foreign Application Priority Data

Aug. 18, 2014 (EP) ..... 14181248
Aug. 18, 2014 (GB) ..... 1414596.5

(51) Int. Cl.
*H01J 49/16* (2006.01)
*H01J 49/04* (2006.01)

(52) U.S. Cl.
CPC ..... *H01J 49/045* (2013.01); *H01J 49/16* (2013.01)

(58) Field of Classification Search
None
See application file for complete search history.

(56) References Cited

U.S. PATENT DOCUMENTS 7,368,728 B2 * 5/2008 Cristoni ..... H01J 49/0468 250/281
8,232,520 B2 * 7/2012 Cristoni ..... H01J 49/04 250/281
9,378,938 B2 * 6/2016 Gordon ..... H01J 49/0431
9,618,488 B2 * 4/2017 Bajic ..... H01J 49/0454
2015/0287581 A1 * 10/2015 Bajic ..... H01J 49/0445 250/282

FOREIGN PATENT DOCUMENTS

WO WO 2013093517 A1 * 6/2013 ..... H01J 49/0454
WO WO 2014064399 A1 * 5/2014 ..... H01J 49/0445

OTHER PUBLICATIONS

Kestin et al., "*On the stability of two-dimensional stagnation flow*", Journal of Fluid Mechanics, vol. 44, Part 3, pp. 461-479, 1970.

* cited by examiner

*Primary Examiner* — Andrew Smyth
(74) *Attorney, Agent, or Firm* — Womble Bond Dickinson (US) LLP; Deborah M. Vernon; Heath T. Misley

(57) ABSTRACT

There is provided an ion source comprising one or more nebulizers and one or more targets, wherein said one or more nebulizers are arranged and adapted to emit, in use, a stream predominantly of droplets which are caused to impact upon said one or more targets and to ionize said droplets to form a plurality of ions, wherein said one or more targets further comprise one or more structures configured to disturb gas flowing along a surface of said one or more targets.

18 Claims, 5 Drawing Sheets

IMPACTOR SPRAY ION SOURCE

CROSS-REFERENCE TO RELATED APPLICATIONS

This application represents the U.S. National Phase of International Application number PCT/GB2015/052390 entitled "Impactor Spray Ion Source" filed 18 Aug. 2015, which claims priority from and the benefit of United Kingdom patent application No. 1414596.5 filed on 18 Aug. 2014 and European patent application No. 14181248.7 filed on 18 Aug. 2014. The entire contents of these applications are incorporated herein by reference.

FIELD OF THE INVENTION

The present invention relates generally to mass spectrometry and in particular to mass spectrometers and methods of mass spectrometry. Various embodiments relate to an ion source and a method of ionising a sample.

BACKGROUND

Atmospheric Pressure Ionisation ("API") sources are commonly used to interface liquid chromatography to a mass spectrometer. There are many types of API sources, including electrospray ("ESI"), atmospheric pressure chemical ionization ("APCI") and impactor spray ("IS") sources.

FIG. 1 shows schematically a conventional standard impactor spray source. This comprises a pneumatic nebulizer assembly 1, a desolvation heater 4, an impactor target 5 and a mass spectrometer inlet assembly comprising cone gas nozzle 6, ion inlet orifice 8 and first vacuum region 9.

This arrangement may be surrounded by a source enclosure that contains an exhaust outlet for the venting of solvent fumes (not shown). The nebuliser assembly 1 is composed of an inner liquid capillary 2 and an outer gas capillary 3 which delivers a high velocity stream of gas at the nebulizer tip to aid the atomization of the liquid solvent flow. The inner liquid capillary 2 may have an internal diameter of 130 μm and an outside diameter of 270 μm. The outer gas capillary 3 may have an inside diameter of 330 μm.

The gas supply (for example nitrogen) is pressurized to approximately 7 bar and liquid flow rates of 0.1 to 1 mL/min are commonly used. A heated desolvation gas (for example nitrogen) flows between the nebulizer 1 and the heater 4 at a flow rate of typically 1200 L/hr.

The high velocity stream of droplets from the nebulizer 1 impact on a 1.6 mm diameter stainless steel, cylindrical rod target 5. Typically, the surface of the rod target 5 is polished and smooth. The illustrated dimensions $x_1$, $y_1$ and $y_2$ are typically 5 mm, 3 mm and 7 mm, respectively. The nebulizer 1 and impactor target 5 are typically held at 0 V and 1 kV, respectively. The mass spectrometer inlet is typically close to ground potential (for example 0-100 V).

A nitrogen curtain gas flow of typically 150 L/hr passes between the cone gas nozzle 6 and the ion inlet cone 10. Ions, charged particles or neutrals that are contained within the gas flow wake 7 from the impactor target 5 can enter the mass spectrometer via the ion inlet orifice 8 which forms a boundary between the first vacuum region 9 of the MS and the atmospheric pressure region of the source enclosure.

When the diameter of the impactor target 5 is significantly greater than the internal diameter of the liquid capillary 2, it is advantageous to direct the spray such that it impacts the target 5 on the upper right hand quadrant, as shown in FIG. 1. Under these conditions, the gas flow wake 7 follows the curvature of the target (Coanda effect) and is swung in the direction of the ion inlet orifice 8 which results in a greater ion signal intensity.

Thus, in an impactor spray source, a nebulizer produces a stream of high velocity liquid droplets in a supersonic gas jet that impinges on a metallic rod target that is held at high voltage and is in close proximity to the nebuliser tip.

WO2013/093517 ("Micromass") discloses interfacing capillary electrophoresis to a mass spectrometer via an impactor spray ionisation source.

WO2014064400 ("Micromass") discloses improved reducibility of impact-based ioinisation source for low and high organic mobile phase compositions using a mesh target.

EP1855306 ("Cristoni") discloses an ionisation source and method for mass spectrometry.

WO2004/034011 ("Cristoni") discloses an ionisation source for mass spectrometry analysis.

It is desired to provide an improved ion source.

SUMMARY

According to an aspect of the present disclosure there is provided an ion source comprising:

one or more nebulisers and one or more targets, wherein the one or more nebulisers are arranged and adapted to emit, in use, a stream predominantly of droplets which are caused to impact upon the one or more targets and or so as to ionise the droplets to form a plurality of ions; and wherein the one or more targets further comprise:

one or more structures configured to disturb gas flowing along or across a surface of the one or more targets.

Modifications to the target surface of an Impactor Spray ion source are proposed, which are designed to encourage additional vortex flow behaviour to enhance the performance of an impactor spray source. Conventional Impactor Spray ion sources involve a target that is typically a planar, curved surface and does not comprise a structure that is configured to disturb gas flowing along its surface. It has been recognised that vortex flow patterns at the target surface may play an important role in the nebulisation, desolvation and ionisation processes in Impactor Spray ion sources, and the present disclosure aims to utilise this recognition.

It will be appreciated that the above ion source requires the target to comprise the one or more structures configured to disturb gas flowing along or across its surface. This is very distinct from, for example, WO2013/093517 ("Micromass") in which the surface of the target is completely smooth.

The stream predominantly of droplets may be caused to impact upon the one or more targets thereby ionising the droplets to form said plurality of ions.

The one or more structures may comprise one or more vortex generating structures, wherein the vortex generating structures are optionally configured to cause a vortex and/or turbulence in gas flowing past the one or more vortex generating structures.

The one or more structures may be configured to promote surface flow vortices that encourage gas flow to remain attached to the surface.

The one or more structures optionally comprise an aerodynamic shape or profile configured to promote surface flow vortices that encourage gas flow to remain attached to the surface.

The one or more structures may be positioned downstream of a stagnation point or line, and/or upstream of a separation point or line.

The one or more structures may comprise one or more strakes or fins having a longitudinal axis that is parallel, off-parallel or perpendicular to the general direction of gas flowing over or around the target.

The one or more structures may comprise a protuberance extending from a surface of the one or more targets and/or a notch or cavity extending into a surface of the one or more targets.

The one or more structures may comprise at least one of:

(i) a single structure or a plurality of structures;

(ii) a single row or multiple rows of structures;

(iii) a cubic, cuboid, cylindrical, or polyhedral structure;

(iv) structures having an irregular spacing between structures;

(v) a continuous micro-patterned surface that is imprinted, etched or micro-machined into a surface of the one or more targets; and (vi) a microstructure.

The one or more structures may be positioned within a predominant direction of gas flowing past the one or more targets.

The one or more structures may be aligned with a predominant direction of gas flowing past the one or more targets.

The one or more targets may comprise a cylindrical tube or rod. A or the predominant direction of gas flowing past the one or more targets may be along or around a portion of the surface, circumference, or circumferential surface of the cylindrical tube.

The one or more targets may comprise a planar surface in the form of a plate, and a or the predominant direction of gas flowing past said one or more targets may be across or along said planar surface.

A height or depth of the one or more structures may be equivalent to, or comparable to a boundary layer thickness of the gas flowing past the one or more targets. For example, a height or depth of the one or more structures may be within +/−0%, 10%, 15%, 20%, 30%, 40%, 50%, 100%, 200%, 500%, 1000%, 2500% or 5000% of a boundary layer thickness of the gas flowing past the one or more targets.

A height or depth of the one or more structures, and/or a distance or spacing between adjacent structures, may be greater than, equal to, or less than: (i) 1 μm; (ii) 2 μm; (iii) 5 μm; (iv) 10 μm; (v) 15 μm; (vi) 20 μm; (vii) 25 μm; (viii) 30 μm; (ix) 35 μm; (x) 40 μm; (xi) 45 μm; (xii) 50 μm; (xiii) 60 μm; (ixv) 70 μm; (xv) 80 μm; (xvi) 90 μm; (xvii) 100 μm; (xviii) 150 μm; (ixx) 200 μm; (xx) 300 μm; (xxi) 400 μm; or (xxii) 500 μm.

The ion source may comprise an Atmospheric Pressure Ionisation ("API") ion source.

According to an aspect of the present disclosure there is provided a mass spectrometer comprising an ion source as described above.

According to an aspect of the present disclosure there is provided a method of ionising a sample comprising:

providing one or more nebulisers and one or more targets, wherein the one or more targets comprises one or more structures configured to disturb gas flowing along a surface of the one or more targets;

causing the one or more nebulisers to emit a stream predominantly of droplets which are caused to impact upon the one or more targets and or so as to ionise the droplets to form a plurality of ions; and disturbing gas flowing along a surface of the one or more targets using the one or more structures.

According to an aspect of the present disclosure there is provided a method of ionising a sample comprising:

providing one or more nebulisers and one or more targets;

causing said one or more nebulisers to emit a stream predominantly of droplets which are caused to impact upon said one or more targets and or so as to ionise said droplets to form a plurality of ions;

using a nebulising gas that satisfies the condition $R_\rho/R_\mu>1$, where:

$$R_\rho=\rho(X)/\rho(N_2);\text{ and}$$

$$R_\mu=\mu(X)/\mu(N_2);$$

where $\rho(X)$ is the density of the nebulising gas, and $\rho(N_2)$ is the density of nitrogen, and $\mu(X)$ is the viscosity of the nebulising gas, and $\mu(N_2)$ is the viscosity of nitrogen.

Various embodiments involve modifications to an impactor spray source design that encourage additional microvorticity for the purpose of enhancing ionization efficiency. Scanning Electron Microscope ("SEM") images from an impactor spray rod target show strong evidence for the existence of such counter rotating microvortices where the characteristic spacing between vortices bears some resemblance to theory.

The term "structure" as used herein may refer to a microstructure, for example having a dimension less than: (i) 1 μm; (ii) 2 μm; (iii) 5 μm; (iv) 10 μm; (v) 15 μm; (vi) 20 μm; (vii) 25 μm; (viii) 30 μm; (ix) 35 μm; (x) 40 μm; (xi) 45 μm; (xii) 50 μm; (xiii) 60 μm; (ixv) 70 μm; (xv) 80 μm; (xvi) 90 μm; (xvii) 100 μm; (xviii) 150 μm; (ixx) 200 μm; (xx) 300 μm; (xxi) 400 μm; or (xxii) 500 μm.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; (xxix) a He plasma (HePI) ion source; and (xxx) a Penning ionisation ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

A chromatography detector may be provided wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The mass spectrometer may be operated in various modes of operation including a mass spectrometry ("MS") mode of operation, a tandem mass spectrometry ("MS/MS") mode of operation, a mode of operation in which parent or precursor ions are alternatively fragmented or reacted so as to produce fragment or product ions, and not fragmented or reacted or fragmented or reacted to a lesser degree, a Multiple Reaction Monitoring ("MRM") mode of operation, a Data Dependent Analysis ("DDA") mode of operation, a Data Independent Analysis ("DIA") mode of operation, a Quantification mode of operation or an Ion Mobility Spectrometry ("IMS") mode of operation.

BRIEF DESCRIPTION OF THE DRAWINGS

Various embodiments of the present disclosure will now be described, by way of example only, and with reference to the accompanying drawings in which.

DETAILED DESCRIPTION

Developments in relation to an Impactor Spray ion source, and specifically the gas flow and vortex flow behaviour will now be described.

When a flow of gas approaches a solid object, a point may be reached where the flow becomes attached to the surface and the local surface velocity may become zero. This may be known as the stagnation point 11 and is shown schematically for an Impactor Spray geometry in FIG. 2.

Figure 2:
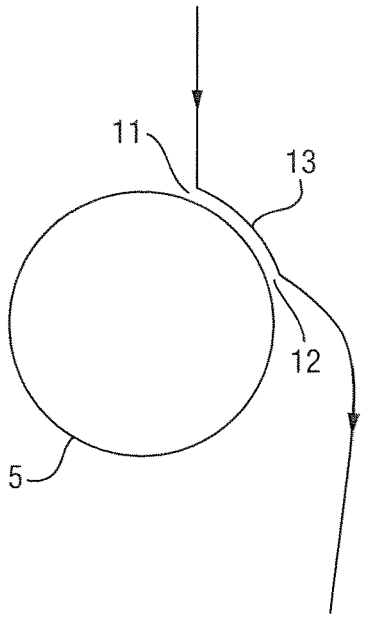
Fig. 2 Prior Art
FIG. 2 shows a schematic of the stagnation zone for gas flowing past a cylinder.

The stagnation region 13 may be bounded by the stagnation point 11 where the flow optionally becomes attached to the surface, and the separation point 12 where the flow optionally separates from the surface. Although FIG. 2 shows the gas streamline displaced to the right hand side of the rod axis, it is understood that a centralized gas flow from the Impactor Spray nebulizer may result in two symmetrical streamlines on either side of the target 5.

The vortex phenomena that occur in the stagnation region 13 have been modelled ("On the Stability of Two-Dimensional Stagnation Flow" by J. Kestin and R. T. Wood, Fluid Mech. (1970), vol. 44, Part 3, pp. 461-479, referred to herein as "Kestin and Wood (1970)") for a cylindrical geometry in cross flow. Such vortex phenomena may be encountered in an Impactor Spray ion source. The theory characterizes the well-established observations that cylinders in cross flow may exhibit a linear series of counter-rotating surface vortices whose axes of rotation are aligned with the gas flow streamlines.

Figure 3:
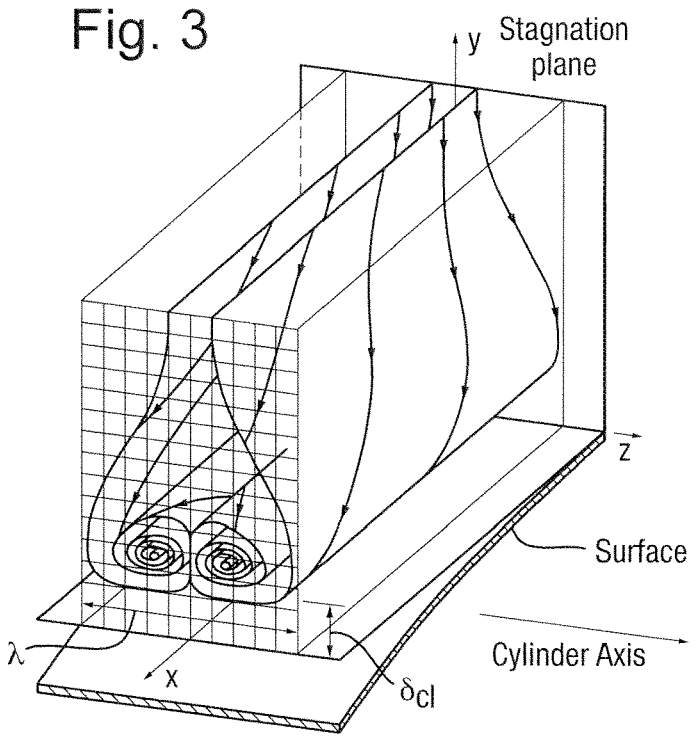
FIG. 3 shows counter-rotating vortices in gas flowing past a cylinder, from Kestin and Wood (1970)
Figure 4:
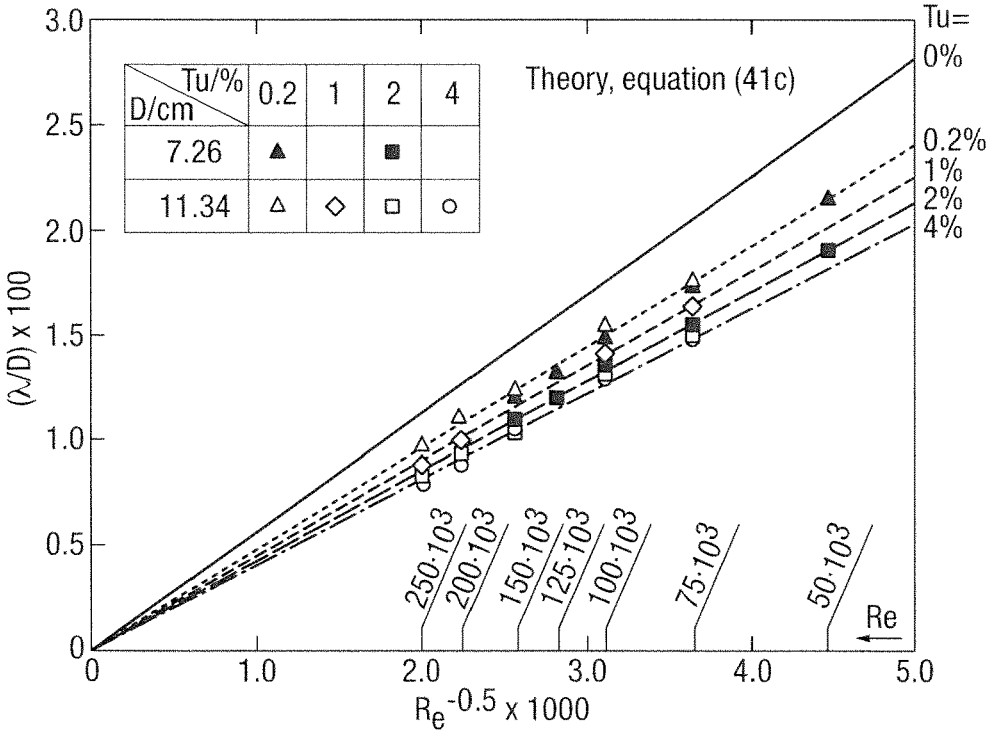
FIG. 4 shows a microvorticity relationship graph from Kestin and Wood (1970)

FIG. 3 shows an illustration of a counter-rotating pair of surface vortices. The distance spanned by a counter-rotating pair may be known as the disturbance wavelength, λ, which may be found to be directly proportional to the cylinder diameter, D, and may be inversely proportional to the square root of the Reynolds number, $R_e$;

$$\lambda = \text{const} D R_e^{-0.5} \quad \text{(i)}$$

and $$R_e = \rho v D / \mu \quad \text{(ii)}$$

wherein ρ is the gas density, v is the free-stream gas velocity (away from the surface) and μ is the gas viscosity. A plot of λ/D versus $R_e^{-0.5}$ for various turbulence intensities (Tu) is shown in FIG. 4.

Figure 5:
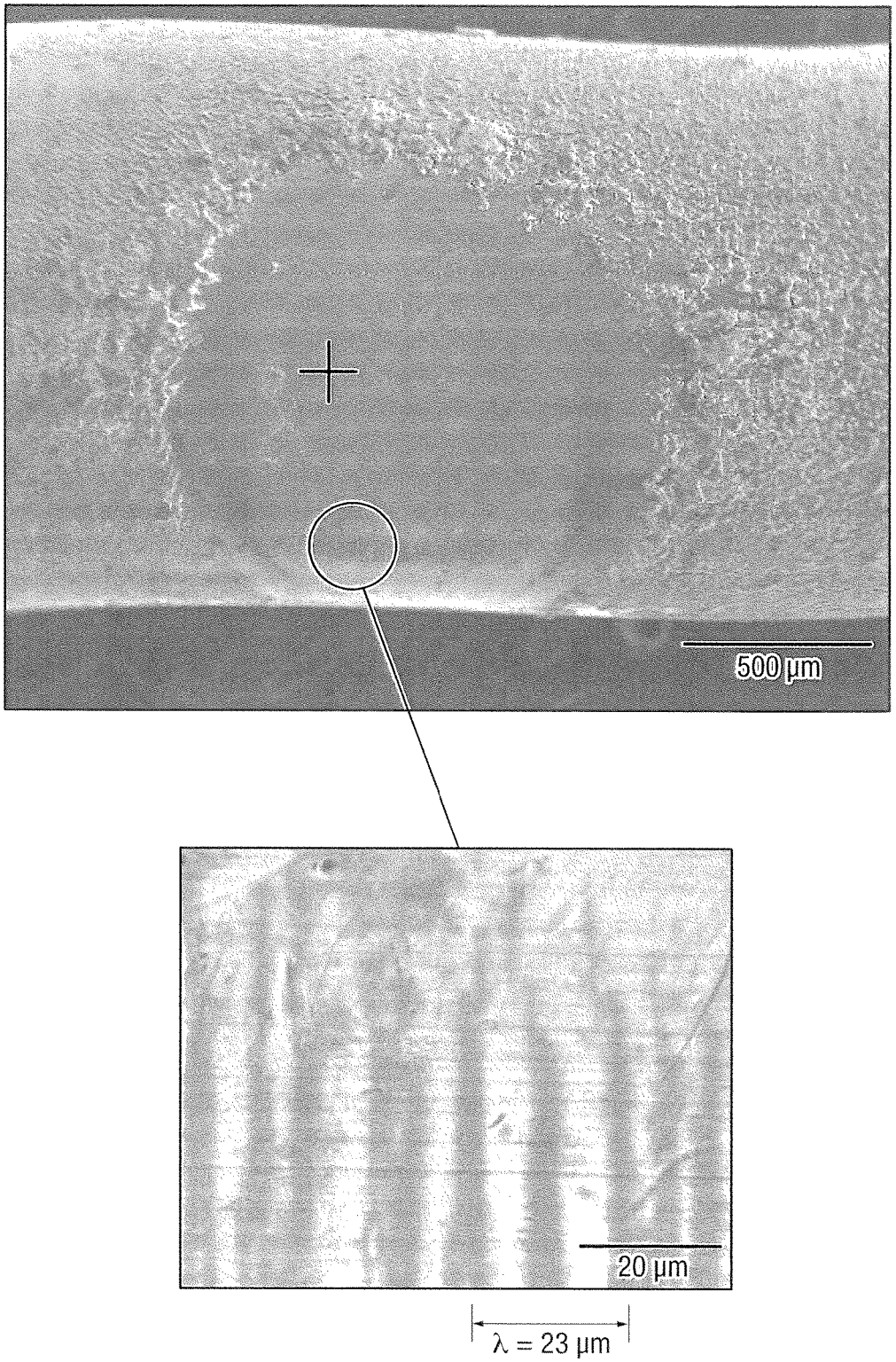
FIG. 5 shows a Scanning Electron Microscope ("SEM") image of a cylindrical impactor spray target.

FIG. 5 shows a Scanning Electron Microscope ("SEM") image of an Impactor Spray target (for example a 1.6 mm diameter, stainless steel Impactor Spray target) which was used as described above for the analysis of analytes contained in protein-precipitated human plasma. The granular, circular "halo" is due to the deposition of involatile components of the plasma and is outside of the area of interest for the present discussion.

The SEM image was taken in the same direction as the impinging droplet stream and nebulizer gas jet. The cross (+) in FIG. 5 may represent an approximation of the impact point of the centre of the incoming gas jet. A close examination of the circled region of the image reveals a linear series of striation marks which are aligned with the direction of the flow streamlines. These striation marks may be evidence of the existence of counter-rotating surface vortices as described.

Figure 1:
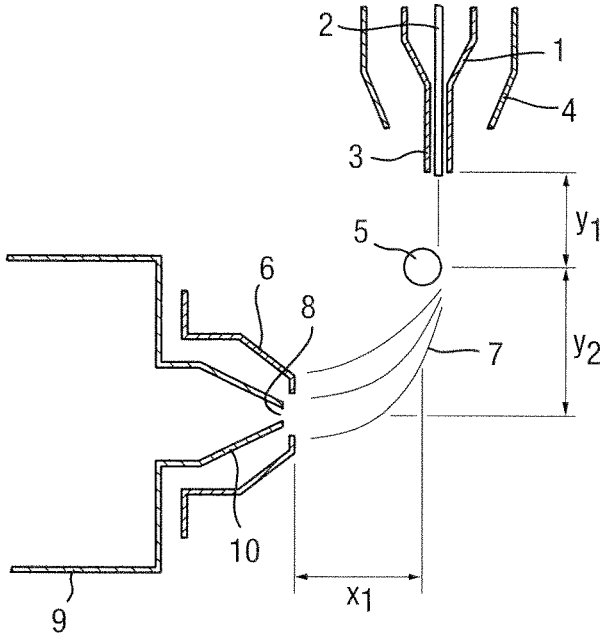
Fig. 1 Prior Art
FIG. 1 shows a conventional impactor spray ion source.

Referring to FIG. 1, the distance $y_1$ between the nebulizer tip and the target is typically 3 mm. At such close distances, the gas velocity may be supersonic, where, at for example Mach 1, we can estimate $R_e$ to be approximately 30,000 for nitrogen gas at a temperature of 100° C. If we transpose this value onto the plot shown in FIG. 4, we obtain a disturbance wavelength value of λ=37 μm for D=1.6 mm and assuming Tu=4%. This compares to an experimentally determined λ=23 μm from FIG. 5, assuming that three striation marks represent the outer extent and centre of one counter-rotating vortex pair.

Thus, there appears to be some correlation between the observed experimental data and the theory of vorticity for cylinders in cross-flow.

It follows from equations (i) and (ii) that a greatest concentration of surface vortices may result from the use of dense gases which have low viscosities, i.e. those that give rise to high Reynolds numbers, $R_e$. If we compare the available data for carbon dioxide and butane (at 400 K), we would increase $R_e$ by factors of 1.77 and 4.6, respectively, over those obtained with nitrogen as the nebulising gas. Thus, if vorticity is an important factor for Impactor Spray sources, this may advocate the use of high density, low viscosity nebulizer gases.

We can define a ratio of density, $R_\rho$, between a chosen gas (X) and nitrogen ($N_2$) as:

$$R_\rho = \rho(X)/\rho(N_2) \quad \text{(ii)}$$

and a ratio of viscosity, $R_\mu$, where:

$$R_\mu = \mu(X)/\mu(N_2) \quad \text{(iv)}$$

It follows from equations (i) and (ii) that increased microvorticity will result from the use of nebulising gases that fulfil the condition:

$$R_\rho / R_\mu > 1 \quad \text{(v)}$$

These surface vortices may play an important role in the shearing of liquid droplets which could enhance the so-called "ion spray" and "sonic spray" mechanisms that yield gas phase ions and charged droplets in API sources. Furthermore, these cross flow surface channels may guide surface liquid towards the separation point where secondary droplets or ions may be ejected following a period of double layer formation within the surface liquid filaments (or rolling droplets).

Referring to FIG. 5, if we assume that the cross (+) represents the approximate location of the flow stagnation point (or line) and the end of the striation marks represent the flow separation point (or line), we can determine from a simple geometric projection that the Impactor Spray target stagnation zone may subtend a radial angle of approximately 46 degrees.

For a 1.6 mm diameter rod target, as typically used in Impactor Spray sources, this may equate to a stagnation zone that is typically 0.65 mm long. Since the surface vorticity is associated with the stagnation zone, one might assume that any gross interference with this region would have detrimental effects on the performance of the Impactor Spray source.

Figure 6:
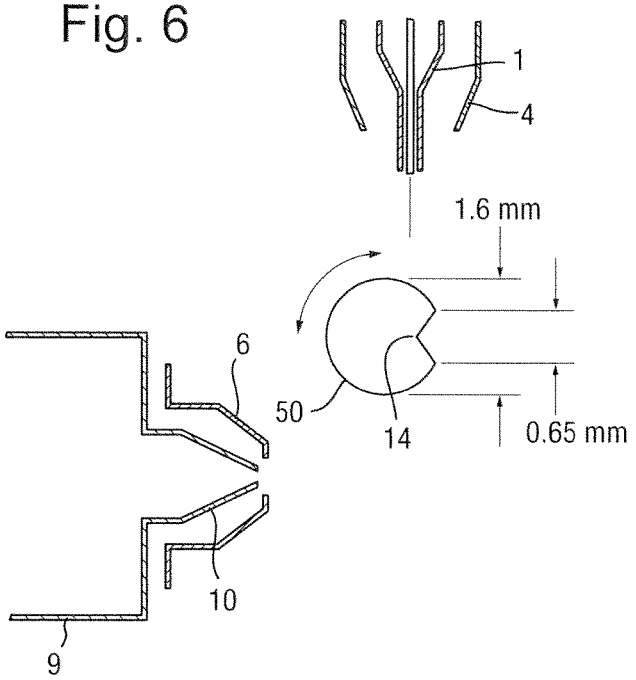
FIG. 6 shows an impactor spray ion source comprising a target incorporating a surface groove.

An experimental geometry is shown schematically in FIG. 6, in which a surface groove 14, with an equivalent width to the stagnation length (0.65 mm), is cut longitudinally into a 1.6 mm diameter stainless steel rod target 50. It has been shown that by rotating the position of the groove 14 with respect to the stagnation region (upper right hand quadrant), significant sensitivity decreases may be observed when the groove overlaps the stagnation region.

Figure 7:
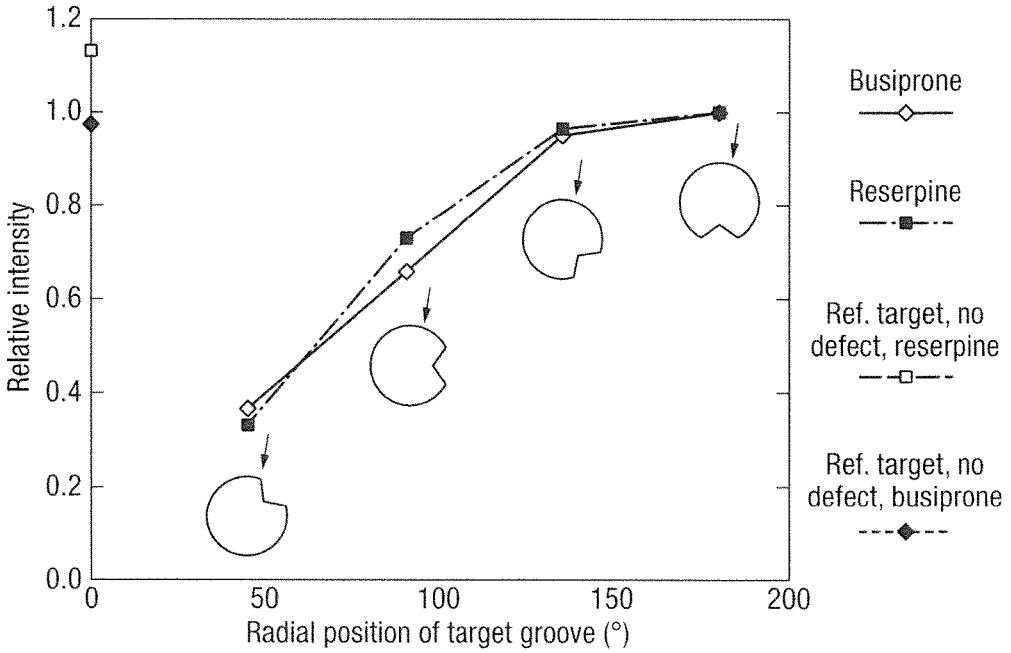
FIG. 7 shows a graph illustrating a relationship between groove position and signal intensity.

FIG. 7 shows the effect of target groove position on the relative signal intensity for an Impactor Spray/Mass Spectrometry analysis of busiprone and reserpine which were infused into the source at a concentration of 0.125 pg/μL and a flow rate of 0.8 mL/min. In the illustrated embodiment, the highest sensitivity is observed when the groove is positioned well away from the stagnation zone (upper right hand quadrant). The lowest sensitivity is observed when the groove completely overlaps the upper quadrant, where presumably, the stagnation region is overwhelmed by turbulence such that the clear definition between a stagnation zone and free-stream flow no longer exists. The two additional reference points for busiprone and reserpine were obtained from a different target which contained no groove, but had a 1.6 mm diameter.

This experiment does not necessarily distinguish between the relative importance of vorticity or the spray steering (Coanda) effect of the gas flow which directs ions and charged droplets towards the ion inlet cone. However, it may be reasonable to suggest that by increasing the length of the existing stagnation region on the standard rod target, it may be possible to increase the sensitivity of an Impactor Spray ion source.

It is known from aircraft wing design that flow at a surface is more likely to become detached under conditions of low turbulence. Thus in order to increase the length of the stagnation region and hence reduce the chances of stalling under high angles of attack, aircraft wings incorporate vortex generators which are attached along the length of the wing in a position that is downstream but close to the stagnation line. These are typically triangular, rectangular or square features that are most effective when their height is equivalent to the thickness of the boundary layer at their point of attachment to the wing. A vortex generator can also take the form of an elongated strake or fin that is aligned in the direction of the flow streamlines.

If we assume a planar surface geometry, the thickness of the boundary layer (δ) is given by:

$$\delta=4.91\times R_e^{-0.5} \quad \text{(vi) for laminar flow, or}$$

$$\delta=0.38\times R_e^{-0.2} \quad \text{(vii) for turbulent flow,}$$

wherein x is the distance from the stagnation point and $R_e$ is the Reynolds number for the free stream flow.

For typical Impactor Spray operating conditions, the close positioning of the target surface to the nebulizer tip is such that the free stream gas velocity is supersonic and at Mach 1 we would expect $R_e$ to be of the order 30,000. In this case, equations (i) and (ii) would yield boundary layer thicknesses of δ=6 μm and 10 μm, respectively, for x=0.2 mm which is approximately one third of the distance from the start to the end of the stagnation region. This represents a lower limit for the height of a vortex generating structure, or structures, in the case of a 1.6 mm diameter target rod. Historical hot-wire measurements have also shown that surface vortex disturbances can extend to as far as fifty boundary layer thicknesses so it may be expected that the useful height range of a vortex generating structure may be 1-50 times the boundary layer thickness (δ).

An embodiment of the present disclosure will now be described.

Figure 8:
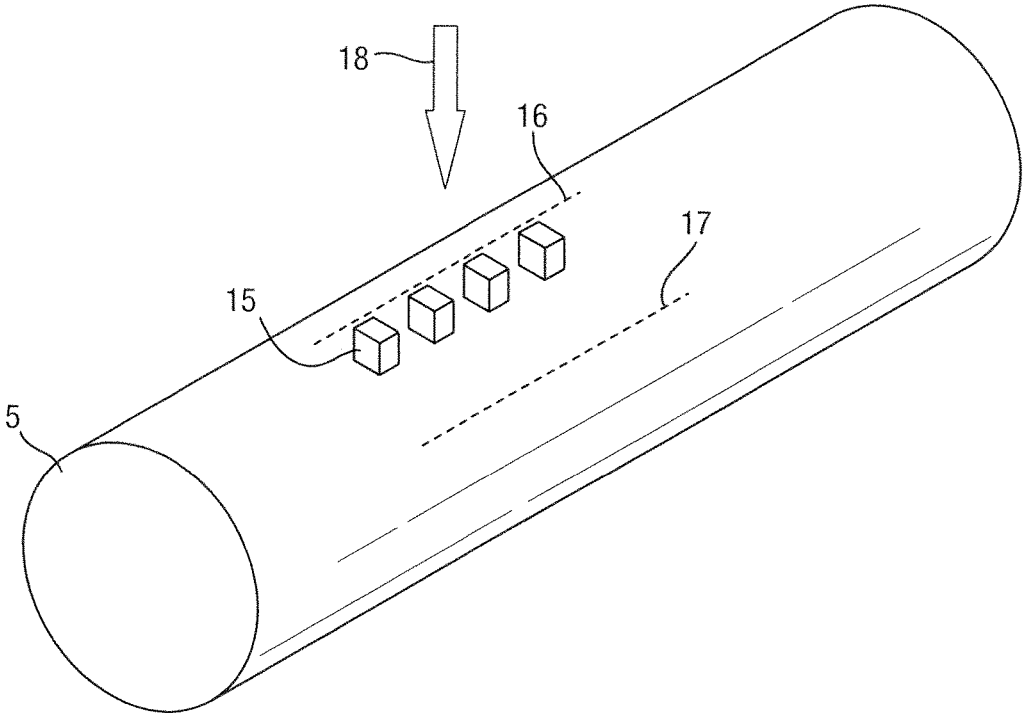
FIG. 8 shows an embodiment of the present disclosure.

FIG. 8 shows a schematic example of a cylindrical rod target 50 in accordance with an embodiment. Target 50 may have surface structures 15, or microstructures, that may serve the purpose of creating surface flow vortices. The surface flow vortices may encourage the flow to remain attached to the target surface.

The size of the structures is exaggerated in FIG. 8 (which is schematic) and may be 10-100 μm in size. The target may be 1.6 mm in diameter. The microstructures may be located downstream from a stagnation line 16 and may be located upstream from a separation line (17). The size or height of the microstructures may be comparable or equivalent to the thickness of the boundary layer of gas flowing around the target. This can create the most effectiveness when attempting to generate vortices using the microstructures.

Although the microstructures are shown on the upper right hand quadrant of the target in FIG. 8, an additional set of microstructures may be placed symmetrically on the upper left hand quadrant. The incoming nebulizer droplet stream 18 may be symmetrical, i.e. directed to the Top Dead Centre ("TDC") of the target.

In an embodiment, the cylindrical rod target 5 could instead be a plate target, optionally comprising a planar surface in the form of a plate. The plate target may comprise one or more structures or microstructures on its surface.

The structures or microstructures in any of the aspects or embodiments disclosed herein may not be limited to those shown in FIG. 8, and could comprise or further comprise at least one of:

(i) a single structure or a plurality of structures;

(ii) a single row or multiple rows of structures, for example between the stagnation and separation lines;

(iii) any shape of structure, for example cubes, rectangular cubes, cylinders, or pyramids;

(iv) structures wherein there is an irregular spacing between structures; and (v) a continuous micro-patterned surface that is imprinted, etched or micro-machined into the target.

The structures or microstructures could comprise or further comprise one or more strakes or fins. The strakes or fins may have a longitudinal axis that is parallel, off-parallel or perpendicular to the general direction of gas flowing over or around the target. The strakes or fins may act to alter the direction of gas flowing past the surface and/or promote surface flow vortices to optionally encourage gas flow to remain attached to said surface. The strakes or fins may achieve this by having an aerodynamic shape or profile.

The disclosed aspects and embodiments optionally increase the sensitivity of existing Impactor Spray ion sources and optionally provide a wider range of target types and geometries.

Although the present disclosure has been described with reference to various embodiments, it will be understood by those skilled in the art that various changes in form and detail may be made without departing from the scope of the disclosure as set forth in the accompanying claims.

The invention claimed is:

1. An ion source comprising:

one or more nebulisers and a target, wherein said one or more nebulisers are arranged and adapted to emit, in use, a stream predominantly of droplets which are caused to impact upon said target so as to ionise said droplets to form a plurality of ions; and wherein said target further comprises:

one or more structures configured to disturb gas flowing along a curved surface of said target, wherein said stream predominantly of droplets is caused to impact upon said curved surface, and the one or more structures extend from or into the curved surface.

2. An ion source as claimed in claim 1, wherein said one or more structures comprises one or more vortex generating structures.

3. An ion source as claimed in claim 1, wherein said one or more structures are configured to promote surface flow vortices that encourage gas flow to remain attached to said curved surface.

4. An ion source as claimed in claim 1, wherein said one or more structures comprise an aerodynamic shape or profile configured to promote surface flow vortices that encourage gas flow to remain attached to said surface.

5. An ion source as claimed in claim 1, wherein said one or more structures are positioned downstream of a stagnation point or line located on the curved surface, and/or upstream of a separation point or liner located on the curved surface.

6. An ion source as claimed in claim 1, wherein said one or more structures comprises a protuberance extending from the curved surface of said target and/or a notch or cavity extending into the curved surface of said target.

7. An ion source as claimed in claim 1, wherein said one or more structures comprise one or more strakes or fins having a longitudinal axis that is parallel, off-parallel or perpendicular to the general direction of gas flowing over or around the curved surface of the target.

8. An ion source as claimed in claim 1, wherein said one or more structures comprises at least one of:

(i) a single structure or a plurality of structures extending from or into the curved surface;

(ii) a single row or multiple rows of structures extending from or into the curved surface;

(iii) a cubic, cuboid, cylindrical, or polyhedral structure extending from or into the curved surface;

(iv) structures having an irregular spacing between structures; and (v) a continuous micro-patterned surface that is imprinted, etched or micro-machined into the curved surface of said target.

9. An ion source as claimed in claim 1, wherein said one or more structures is positioned or aligned within a predominant direction of gas flowing past said target.

10. An ion source as claimed in claim 1, wherein said a target comprises a cylindrical tube or rod, and a or the predominant direction of gas flowing past said target is around a portion of the circumference of said cylindrical tube or rod.

11. An ion source as claimed in claim 1, wherein a height or depth of said one or more structures is equivalent to, or comparable to a boundary layer thickness of said gas associated with the curved surface of said target.

12. A mass spectrometer comprising an ion source as claimed in claim 1.

13. A method of ionising a sample comprising:

providing one or more nebulisers and a target, wherein said target comprises one or more structures configured to disturb gas flowing along a surface of said target;

causing said one or more nebulisers to emit a stream predominantly of droplets which are caused to impact upon a curved surface of said target so as to ionise said droplets to form a plurality of ions; and disturbing gas flowing along the curved surface of said target using said one or more structures, wherein the one or more structures extend from or into the curved surface.

14. An ion source comprising:

one or more nebulisers and a target, wherein said one or more nebulisers are arranged and adapted to emit, in use, a stream predominantly of droplets which are caused to impact upon said target;

wherein said target further comprises:

one or more structures configured to disturb gas flowing along a curved surface of said target, wherein said one or more structures are configured to promote surface flow vortices that encourage gas flow to remain attached to said curved surface, wherein said stream predominantly of droplets is caused to impact upon said curved surface, and the one or more structures extend from or into the curved surface.

15. An ion source as claimed in claim 14, wherein said one or more structures comprises a notch or cavity extending into the curved surface of said target.

16. An ion source as claimed in claim 14, wherein said one or more structures comprises a continuous micro-patterned surface that is imprinted, etched or micro-machined into the curved surface of said target.

17. An ion source as claimed in claim 14, wherein a height or depth of said one or more structures extending from or into the curved surface is less than 500 μm.

18. An ion source as claimed in claim 14, wherein said ion source is an Electrospray ionisation ("ESI") ion source.

* * * * *